US006575693B2

(12) United States Patent
Pross et al.

(10) Patent No.: US 6,575,693 B2
(45) Date of Patent: Jun. 10, 2003

(54) LABYRINTH SEAL FOR ROTATING SHAFT

(75) Inventors: Joerg Pross, Albbruck (DE); Thomas Kramer, Ennetbaden (CH); Ulrich Waltke, Neuenhof (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/887,009

(22) Filed: Jun. 25, 2001

(65) Prior Publication Data

US 2002/0006330 A1 Jan. 17, 2002

(30) Foreign Application Priority Data

Jun. 23, 2000 (DE) ..... 100 30 820

(51) Int. Cl.[7] ..... F10D 11/02

(52) U.S. Cl. ..... 415/1; 415/173.5; 415/174.5; 415/230

(58) Field of Search ..... 415/168.2, 173.1, 415/173.5, 173.6, 173.7, 174.5, 180, 230, 1

(56) References Cited

U.S. PATENT DOCUMENTS 4,057,362 A * 11/1977 Schwaebel ..... 415/174.5 X 6,168,377 B1 * 1/2001 Wolfe et al. ..... 415/174.5 X

FOREIGN PATENT DOCUMENTS

| | | |
|---|---|---|
| DE | 675124 | 4/1939 |
| DE | 3523469 A1 | 1/1987 |
| EP | 0799973 A1 | 10/1997 |
| EP | 0943784 A1 | 9/1999 |
| EP | 0982475 A1 | 3/2000 |

OTHER PUBLICATIONS

"Ausfuhrung der Hauptteile", Schroder, K., Dampfkraftwerke, B.Bd, Teil B. Springer Verlag 1968, pp. 68–69.

* cited by examiner

*Primary Examiner*—Edward K. Look
*Assistant Examiner*—Richard Edgar
(74) *Attorney, Agent, or Firm*—Burns, Doane, Swecker & Mathis, L.L.P.

(57) ABSTRACT

Between the rotor and stator of an axial turbo machine, sealing strips of a labyrinth seal that are mortised into sealing strip grooves are provided. Between the sealing strips relief grooves are provided in such a way that the axial stiffness of the rotor or stator is essentially steady. This may be achieved by one or more flat relief grooves, a corrugated surface, or by filling the relief grooves entirely or partially with a suitable, elastic material so that a more even axial tension distribution is achieved between the sealing strip grooves and relief grooves along the rotor or stator section.

19 Claims, 2 Drawing Sheets

LABYRINTH SEAL FOR ROTATING SHAFT

FIELD OF THE INVENTION

This invention relates to turbomachines, and more particularly to labyrinth seals for rotor and stator labyrinths.

BACKGROUND OF THE INVENTION

Labyrinth seals used as a seal between rotating and static parts of axial turbomachines are known in general from the state of the art. Unexamined patents (Offenlegungsschriften) DE-A1-35 23 469, EP-A1-982 475, EP-A1-799 973, or EP-A1-943 784, the disclosures of which are incorporated herein by reference, describe various embodiments of such turbomachines with sealing strips, and labyrinths located in between the latter. These sealing strips usually are mortised into a peripheral groove of the rotor and stator, as shown, for example, in FIG. 1 of EP-A1-982 475. Depending on the pressure differential occurring across the sealing strips, the labyrinth seal can be constructed in different ways. There are, for example, simple and double seals. Especially in the case of large pressure differentials, several sealing strips distributed over the length of the labyrinth also can be used as seals.

Several factors limit the geometrical arrangement of the sealing strips on the rotor or stator. During non-stationary processes, i.e., for example, during start-up or shut-down or when changing loads, the thermal load on the sealing strips is very high because of the changing temperature fields and resulting temperature gradients. This creates thermal tensions, particularly at the surface, and in this way causes cyclical fatigue. The peripheral grooves hereby act as notches that increase the axial tension component. In order to reduce the notch effect of a groove, the entire labyrinth can be set off from the rest of the component, for example, by increasing the height of the labyrinth part and by appropriately designed transition radii; this reduces the load primarily on the first and last groove. For the remaining grooves, a certain relief effect is achieved by the respective adjacent grooves, i.e., the notch factor of a groove within such an arrangement of several grooves is lower than that of a single, isolated groove with the same geometry.

It is known from various studies that the optimal distance between two grooves with respect to mutual load relief within an arrangement of several consecutive grooves is generally smaller than the distance that should be selected for functional reasons between two sealing strips in a labyrinth seal. This means that in the case of high transient thermal mechanical loads, in particular towards the center of a labyrinth section, both cyclical life span problems as well as severe deformations of the individual fastening grooves occur as a result of the notch effect of the fastening grooves. Since the notch effect acts on the axial tension component, a strong axial deformation of the groove occurs during each operating cycle. The deformation may be such as to even create inelastic sections, which on the one hand causes a continuous gradual detachment of the mortised sealing strips, and on the other hand, also causes a decrease in the preload force achieved during the mortising. In the end, this deformation causes a loss of the corresponding sealing strip. Because of the cyclical fatigue, superficial fissures in the groove base of the sealing strip groove also must be expected.

For this reason, K. Schröder suggests in *Dampfkraftwerke* (3rd Vol., Part B, Springer Verlag, 1968, p. 68–69) to cut relief grooves between two sealing strips. This has the objective of compensating tensions caused by the mortising and reducing the thermal load when a plate is brushed against. Such an arrangement of individual relief grooves that have more than twice the depth than sealing strip grooves has a limited positive influence on the thermal tension reduction. However, a specific reduction of the thermal tensions between the sealing strips is not possible or is possible only to a limited degree with this type of relief grooves, in particular, because an increase in the number of relief grooves requires that a specific wall thickness must be preserved in any case between two relief grooves. This means that these relief grooves in no way can be arranged in an optimal manner. As a rule, such designs result in a shift of the problems, not in a solution. In particular, deeper cuts should be avoided if only to prevent a swirling of the leakage current in these cuts and the associated heating of the flowing medium. In addition, individual relief grooves with the same depth as or deeper than the sealing strip grooves in general have a poorer fatigue-stress concentration factor than the sealing strips, so that the fatigue problem shifts to the relief groove. This is very undesirable, in particular, for seals on shafts.

SUMMARY OF THE INVENTION

It is an objective of this invention to avoid the described disadvantages. The invention has the objective of optimizing a known labyrinth seal in such a way that the thermal tensions or deformations between two sealing strips can be controlled in a targeted manner in order to avoid the above-mentioned damage mechanisms, and that an additional heating of the component by a swirling of the leakage current can be avoided.

According to the invention, these objectives are achieved in a labyrinth seal wherein the axial stiffness of the rotor or stator between the two sealing strips is substantially steady.

In a first embodiment, at least one flat relief groove is set between two sealing strips and extends over a larger area between the two adjacent sealing strips. It would also be conceivable to provide a plurality of flat relief grooves whose longitudinal extension is correspondingly smaller. In a preferred embodiment, the depth of the relief grooves is reduced to such an extent that only one corrugated surface is located between the two adjoining sealing strips. The desired objective can be realized advantageously in this manner, whereby the increased number of relief grooves enables a very targeted reduction in tension. Abrupt fluctuations in stiffness between the grooves and the rotor or stator are avoided or are kept as small as possible. This advantageously reduces the notch factor.

In another embodiment, it is also possible to use the previously known deep relief grooves if they are filled with a suitable elastic material. This measure is used for the same, above-mentioned purpose of controlled, even distribution of the axial tension over the rotor or stator section between two sealing strips. The relief grooves hereby can be filled entirely or partially with the filling material. In the simplest case, the same wire that is also used for mortising in the sealing strip also can be used as a filling material. In general, any material—preferably in wire form—that has the required elasticity and long-term stability at the operating temperature of the seal can be used.

All embodiments are also advantageous because, in addition to an improved tension absorption or distribution, they also prevent a damaging vortex generation in the labyrinth or within the relief grooves. Such a vortex generation may result in an undesired heating of the flow medium and therefore of the entire rotor or stator section.

BRIEF DESCRIPTION OF THE DRAWINGS

Preferred embodiments of the invention are described herein with reference to the accompanying drawings, in which.

Only the elements essential for the invention are shown. Identical elements are designated with the same reference numbers in the different drawings.

DETAILED DESCRIPTION OF THE INVENTION

Figure 1:
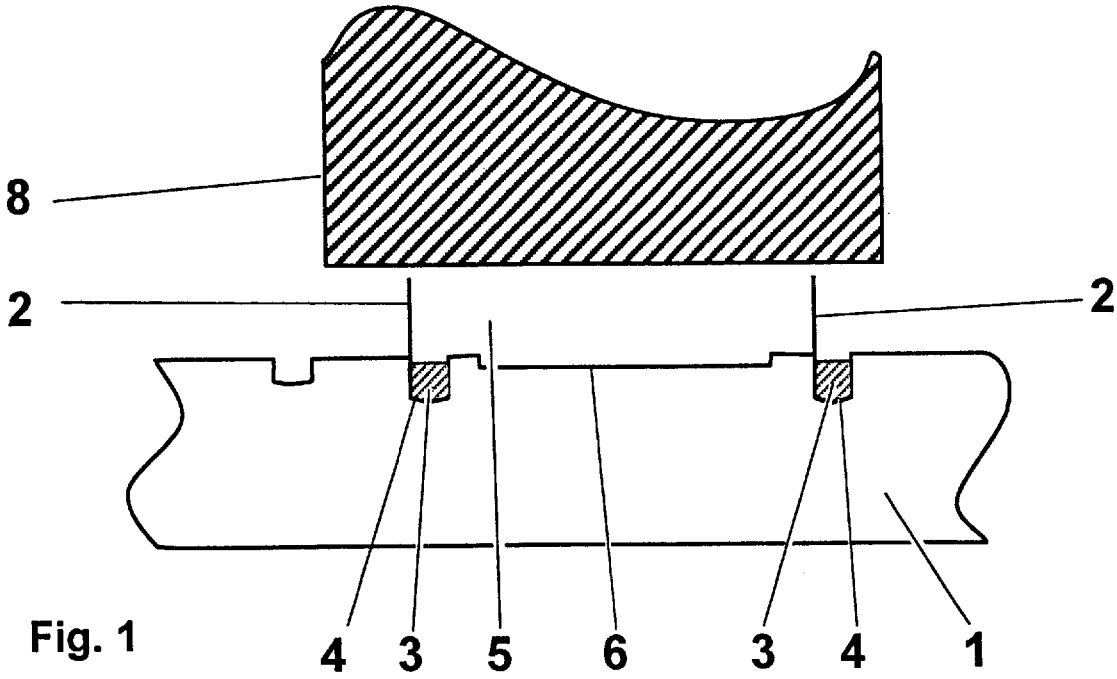
FIG. 1 is a schematic illustration of a first embodiment of the labyrinth seal according to the present invention.
Figure 2:
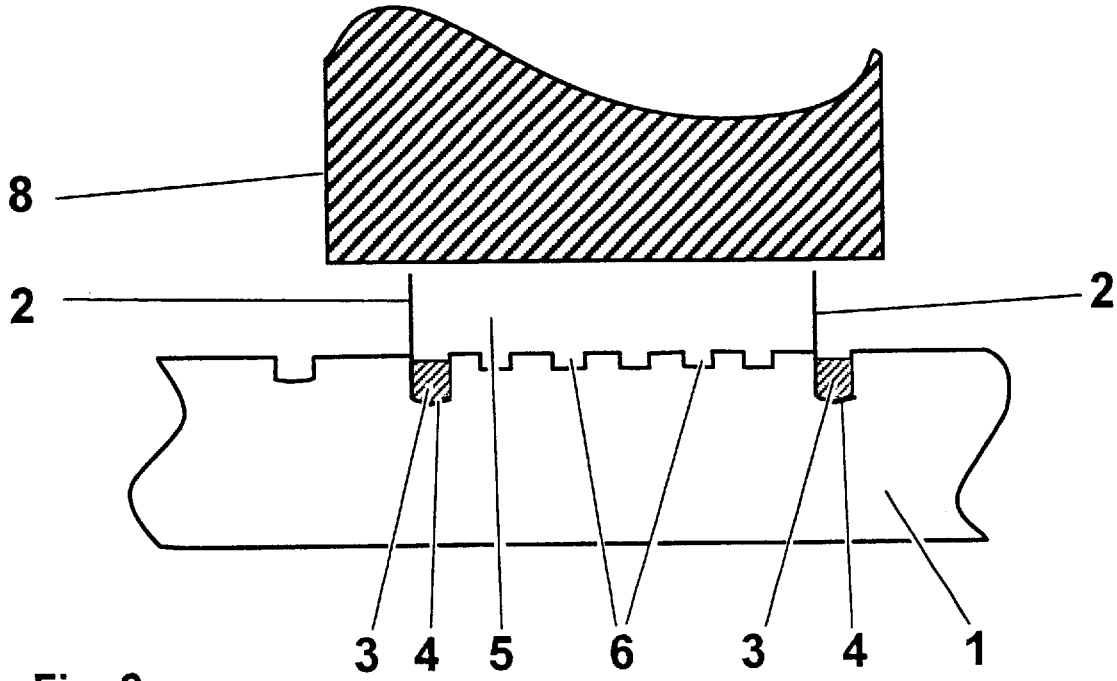
FIG. 2 is a schematic illustration of a second embodiment of the labyrinth seal according to the present invention.

The invention is explained in more detail with reference to FIGS. 1 to 4. FIGS. 1 to 4 show a turbine blade 8 of a thermal turbo machine with a rotor or stator 1. The turbine blade 8 is a guide or rotating blade. In FIGS. 1 to 4, the rotor or stator 1 is provided with sealing strips 2 that are set or mortised in a sealing strip groove 3 into the rotor or stator 1 and are fixed with a mortising wire 4. The sealing strips 2 are arranged so as to be opposite to the turbine blade 8. FIGS. 1 to 4 show relief grooves 6 between the two shown sealing strips 2. According to the invention, no large abrupt fluctuations of the axial stiffness of the rotor or stator 1 occur between the two sealing strips 2, in spite of the existing relief grooves 6, and the axial stiffness is essentially steady.

FIG. 1, this is achieved with a single, flat relief groove 6 extending over a large area between the two sealing strips 2. In contrast, several such flat relief grooves 6 are provided in FIG. 2. The ratio of depth to axial distance of the relief grooves 6 must be optimized in accordance with the respective load situation of the labyrinth 5. The maximum depth of the relief grooves 6 is the depth of the sealing strip groove 3. To meet the requirement for steady axial stiffness, the depth of the relief grooves 6 should ideally be between 25% and 50% of the depth of the sealing strip groove 3. The objective of such an optimization is to distribute the transient axial deformation of the labyrinth section as evenly as possible over the actual sealing strip groove 3 and relief grooves 6. This reduces the stress on the sealing strip groove 3 without putting an excessive stress on the relief grooves 6.

Figure 3:
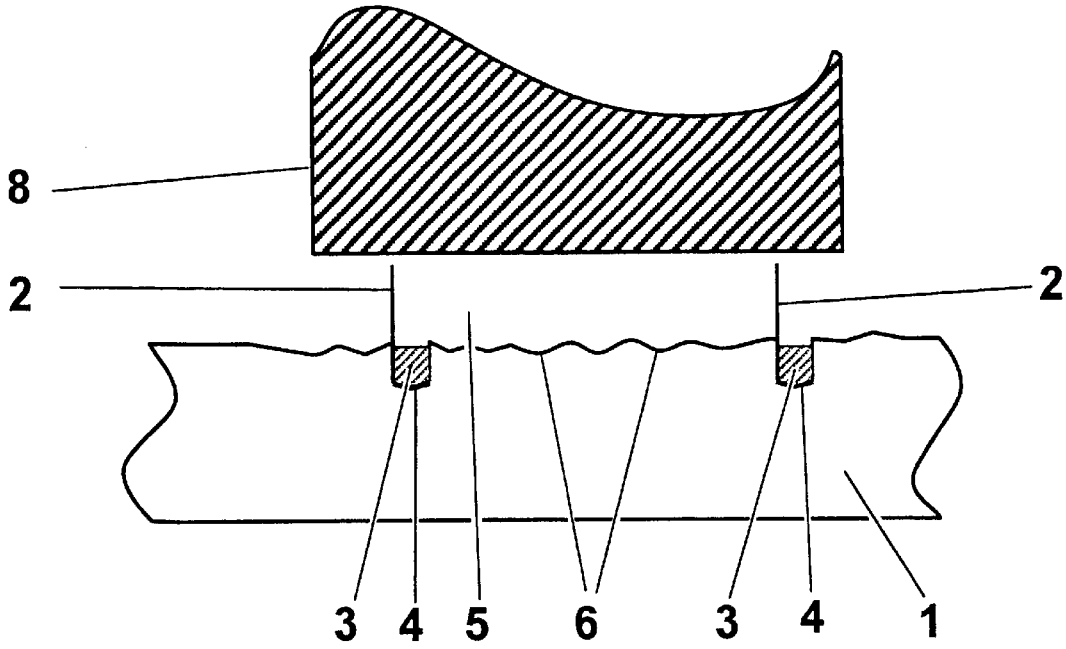
FIG. 3 is a schematic illustration of a third embodiment of the labyrinth seal according to the present invention; and, FIG. 4 is a schematic illustration of a fourth embodiment of the labyrinth seal according to the present invention.

FIG. 3 shows another embodiment of the relief grooves 6 according to the invention. In this case, the relief grooves 6 are so flat and are provided in such numbers that a corrugated surface is created between the sealing strips 2 on the rotor or stator 1.

Figure 4:
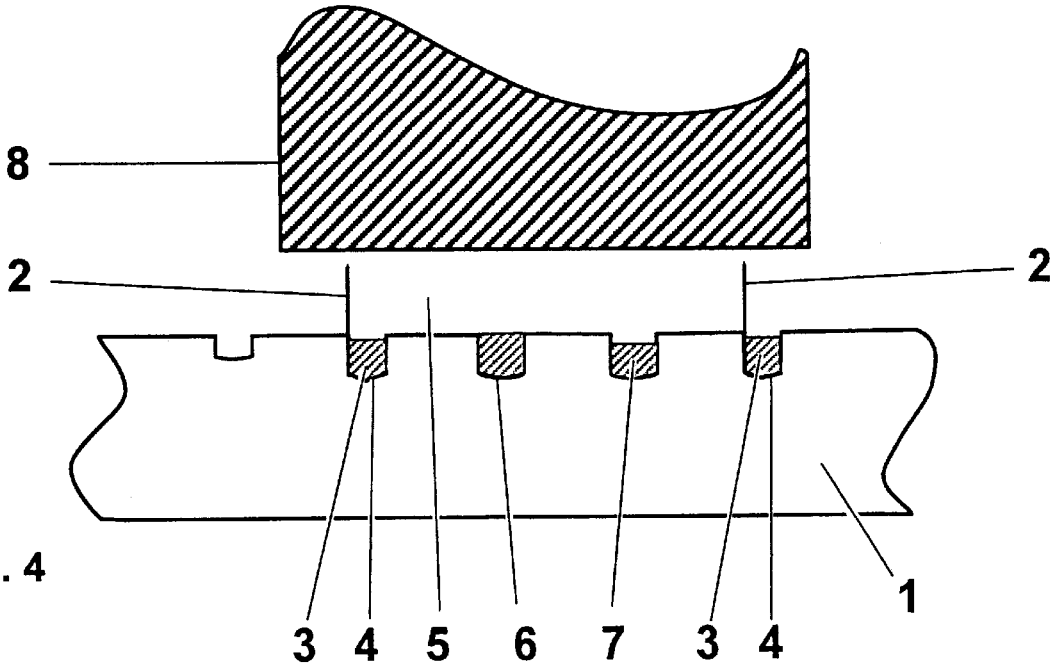

FIG. 4 shows another embodiment of the relief grooves 6, which also makes it possible to use deeper grooves 6. The relief grooves 6 are filled either entirely or partially with a filling material 7, whereby both possibilities can be seen in the relief grooves 6 of FIG. 4. This material can be mortised into the relief grooves 6 analogous to the mortising wire 4 of the sealing strip grooves 3. By selecting the filling material appropriately with respect to its elastic properties and thermal coefficient of expansion, the deformation behavior of the filled relief groove 6 and therefore the entire axial stiffness of the labyrinth area can be controlled within certain limits. The filling material also makes it possible to use the deeper relief grooves known from the state of the art, without worsening the cyclical life span problem. In the simplest case, the same wire that is also used for mortising in the sealing strips also can be used as a filling material. In general, any material—preferably in wire form—that has the required elasticity and long-term stability at the operating temperature of the seal can be used.

With all exemplary embodiments it must be observed that the remaining wall thickness in each case is not so weak that the bracing of the sealing strips 2 in the sealing strip groove 3 is too much reduced. The permissible depth of the relief grooves 6 also depends on this. All embodiments are also advantageous because, in addition to an improved tension absorption or distribution, they also prevent a damaging vortex generation in the labyrinth or within the relief grooves. Such a vortex generation may result in an undesired heating of the flow medium and therefore of the entire rotor or stator section.

What is claimed is:

1. A method to provide a labyrinth seal to a rotor or a stator comprising the steps of:

disposing a first sealing strip at a first end of a stator or a rotor in a first sealing strip groove having a first depth;

disposing a second sealing strip at a second end of a stator or a rotor in a second sealing strip groove having a second depth; and providing a relief groove between the first and second sealing strips, the relief groove having a depth less than or equal to the first depth or the second depth.

2. The method of claim 1, wherein the depth of the relief groove 25–50% of the depth of the first or second sealing strip groove.

3. The method of claim 1, further comprising the step of:

at least partially filling the relief groove with an elastic filling material.

4. The method of claim 1, wherein the depth of the relief groove is effective to provide an essentially even distribution of a transient axial deformation of the labyrinth seal over the first and second sealing strip grooves and the relief groove.

5. The method of claim 1, wherein the depth of the relief groove is effective to provide an even distribution of a transient axial deformation of the labyrinth seal over the first and second sealing strip grooves and the relief groove.

6. The method of claim 1, wherein an axial stiffness of the rotor or stator between the first and second sealing strips is essentially constant.

7. Labyrinth seal between rotating and static parts of an axial turbomachine with a rotor and a stator, said labyrinth seal comprising a first sealing strip and a second sealing strip, each sealing strip provided between the rotating and static parts, whereby each sealing strip is provided in a sealing strip groove on the rotor or stator, and whereby at least one relief groove is provided on the rotor or the stator between the first and second sealing strips, wherein the at least one relief groove has a depth no greater than a maximum depth of the first or second sealing strip groove.

8. Labyrinth seal as claimed in claim 7, wherein the at least one relief groove is a plurality of relief grooves, each relief groove with a depth no greater than the maximum depth of the first or second sealing strip groove and each relief groove is provided on the rotor or the stator between the first and second sealing strips.

9. Labyrinth seal as claimed in claim 7, including a seal between a turbine blade and the rotor or stator.

10. Labyrinth seal as claimed in claim 7, wherein an axial stiffness of the rotor or stator between the first and second sealing strips is substantially steady.

11. Labyrinth seal as claimed in claim 7, wherein the at least one relief groove is filled entirely or partially with an elastic filling material.

12. Labyrinth seal as claimed in claim 11, wherein the filling material is a wire.

13. Labyrinth seal as claimed in claim 7, wherein the depth of the at least one relief groove is 25% to 50% of the maximum depth of the first or second sealing strip groove.

14. Labyrinth seal as claimed in claim 13, wherein the at least one relief groove consists of a corrugated rotor or stator surface between the two sealing strips.

15. Labyrinth seal as claimed in claim 13, wherein an axial stiffness of the rotor or stator between the first and second sealing strips is substantially steady.

16. A labyrinth seal comprising:

a plurality of sealing strips;

an associated sealing strip groove operatively disposed on a rotor or a stator; and at least one relief groove filled with a filling material, wherein the at least one relief groove has a depth of at least a maximum depth of the sealing strip groove, the depth of the at least one relief groove effective to distribute a transient axial deformation of the labyrinth evenly over the plurality of sealing strips and the at least one relief groove.

17. Labyrinth seal as claimed in claim 16, including a seal between a turbine blade and the rotor or stator.

18. Labyrinth seal as claimed in claim 16, wherein the at least one relief groove is filled entirely or partially with an elastic filling material.

19. Labyrinth seal as claimed in claim 18, wherein the filling material is a wire.

* * * * *